United States Patent [19]

Bisson

[11] Patent Number: 4,719,867

[45] Date of Patent: Jan. 19, 1988

[54] LOWER WHEEL FABRIC FEEDING DEVICE IN A COLUMN SEWING MACHINE

[75] Inventor: Flavio Bisson, Cava Manara PV, Italy

[73] Assignee: Necchi Societa per Azioni, Pavia, Italy

[21] Appl. No.: 936,253

[22] Filed: Dec. 1, 1986

[30] Foreign Application Priority Data

Jan. 22, 1986 [IT] Italy ..... 42902 A/86

[51] Int. Cl.[4] ..... D05B 27/14

[52] U.S. Cl. ..... 112/318; 112/322

[58] Field of Search ..... 112/318, 319, 322, 314, 112/308, 309

[56] References Cited

U.S. PATENT DOCUMENTS

| | | | |
|---|---|---|---|
| 2,875,716 | 3/1959 | Pinkvoss . | |
| 3,066,625 | 12/1962 | Reeber et al. | 112/322 |
| 3,141,428 | 7/1964 | Reeber et al. . | |
| 3,495,558 | 2/1970 | Dobner et al. . | |
| 3,776,158 | 12/1973 | Zechini | 112/318 |
| 4,643,117 | 2/1987 | Wentz et al. | 112/318 X |

*Primary Examiner*—H. Hampton Hunter

*Attorney, Agent, or Firm*—Stevens, Davis, Miller & Mosher

[57] ABSTRACT

A lower wheel fabric feeding device in a column sewing machine where the oscillatory motion of the feeding shaft is transmitted to a free release wheel which acts on a first gear coupled with two gears, one gear transmitting the motion to the wheel and the other gear preventing reverse rotation of the first gear.

3 Claims, 3 Drawing Figures

LOWER WHEEL FABRIC FEEDING DEVICE IN A COLUMN SEWING MACHINE

DISCLOSURE OF THE INVENTION

The present invention relates to a lower wheel fabric feeding device in a column sewing machine and as a replacement for known dog feeders. Lower wheel fabric feeding devices in column sewing machines are known, where the oscillatory motion of the feeding shaft is transmitted via a first couple of gears, a vertical shaft, a second couple of gears or a clutch-plate to the feeding wheel. In such an arrangement the oscillatory motion of the feeding shaft is transformed into rotary motion for the wheel. As the wheel must turn intermittently in only one rotational way, when the needle is out of work, in order to transport this fabric, on the feeding shaft free wheel devices are provided for transmitting the oscillation of the shaft in one way only.

The vertical shaft, in some solutions, is replaced by a bush in which the hook shaft rotates. This is because the space at ones disposal in the column for lodging the sewing means is very limited.

The above-described lower wheel feeding devices are expensive as the component pieces are numerous and the finishing must be very accurate. Moreover, there are column sewing machines of the dog feeding type and the lower wheel feeding devices cannot easily replace the dog feeding devices in already existing machines.

It is an object of the present invention to overcome the above-described drawbacks.

The technical problem to be solved was to provide a lower wheel feeding which permits replacing easily the dog feeding device devices in already existing column sewing machines without modifying the machine.

The solution of the technical problem is accomplished by withdrawing the content of the sewing machine column and replacing the withdrawn content with a level being connected to a forked lever pivoted at the column and driving a connecting rod fixed to a free release wheel which acts on a gear coupled with a second and a third gear, the third gear carrying the feeding wheel and means being provided for transmitting intermittently the oscillations of the feeding shaft to the wheel.

BRIEF DESCRIPTION OF THE DRAWINGS

Other details and features of the invention will stand out from the description given below by way of non-limitative example and with reference to the accompanying drawings, in which.

DESCRIPTION OF THE PREFERRED EMBODIMENT

Figure 1:
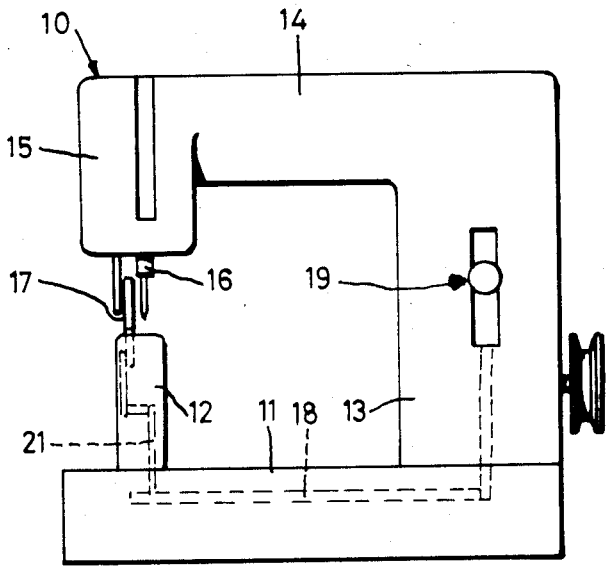
FIG. 1 is a front view of a lower wheel fabric feeding sewing machine.
Figure 2:
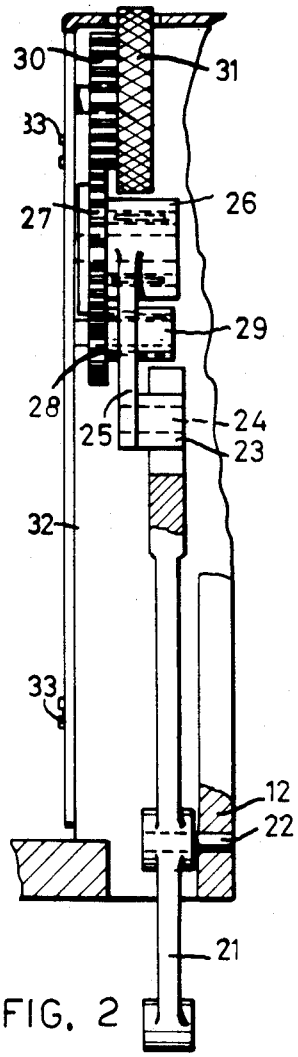
FIG. 2 is an enlarged elevational view of the lower wheel feeding device object.

With reference to FIG. 1, a sewing machine 10 comprises a bed 11, a column 12, a standard 13, a high bracket arm 14 parallel to bed 11 and ending with a head 15 from which extend a needle bar 16 and an upper wheel feeding device 17.

Figure 3:
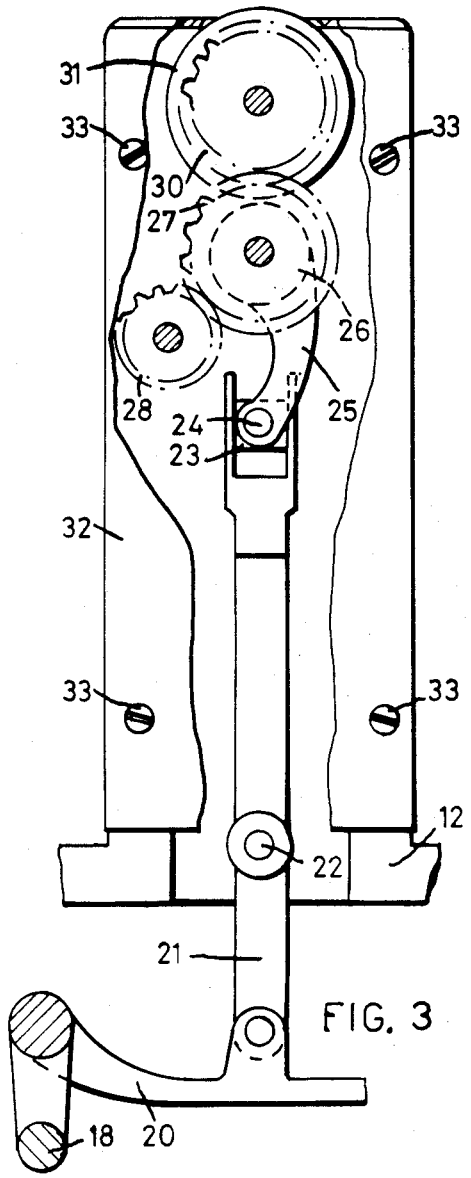
FIG. 3 is a left side elevational view, partially in section, of the feeding device illustrated in FIG. 2 with the closing plate partially removed.

In the bed 11 a feeding shaft 18 oscillates around its axis through known means not illustrated in the drawings. The width of the oscillations of the shaft 18 is controlled in a known way by the stitch length regulator indicated by 19 in FIG. 10. The oscillations of the feeding shaft 18 are transmitted to a lever 20 (FIG. 3) and from this last lever to a forked lever 21 which is pivoted, free to rotate, at a pivot 22 fixed to the internal portion of the column 12. The fork of the lever 21 engages a slide block 23 connected by a pivot 24 to the end of a connecting rod 25, the other end of which is fixed with a free release wheel 26 which acts on a gear 27. The gear 27 is coupled with a second gear 28 on which a second free release wheel 29 acts, which prevents the gear 27 from rotating in the opposite way from the normal way when the connecting rod 25 is returned to its initial working position by means of the oscillation of the forked lever 21. In this way the gear 27 rotates with intermittence in only one way. This intermittent motion is transmitted via the gear 27 to a third gear 30 fixed to the lower feeding wheel 31.

The gears 27, 28 and 30 are mounted on a closing plate 32 fixed to the column 12 by means of screws 33. If it is desired to transform a column sewing machine with dog low feeding into a lower wheel feeding machine, it is sufficient to replace the lever carrying the feed dog pivoted at the pivot 22 with a forked lever 21 and to fix to the column 12 the closing plate 32 carrying the gears 27, 28 and 30, the free release wheels 26 and 29, the connecting rod 25 and the wheel 31 of the low feeding.

In such a way it is possible to transform a machine with traditional feeding into a machine with a lower feeding wheel.

I claim:

1. A lower wheel fabric feeding device for a column sewing machine containing an oscillatable feeding shaft comprising a first lever attached to said feeding shaft, a second lever at one end pivotally connected to said first lever and having a forked section at the other end, said second lever being pivotally connected to said column intermediate the ends of said second lever, a connecting rod having an end slidable within said forked section of said second lever, a first free release wheel, the other end of said connecting rod being fixed to said first free release wheel, a first gear rotated by said first free release wheel, second and third gears coupled to said first gear and a feed wheel rotated by said third gear and means mounted to said second gear to transmit intermittently the oscillations of said feeding shaft and prevent reverse rotation of said first gear.

2. The device of claim 1 wherein said means comprises a second free release wheel.

3. The device of claim 1 including a closing plate mounted on said column, said closing plate mounting said first, second and third gears.

* * * * *